US010634130B2

(12) United States Patent
Moon

(10) Patent No.: US 10,634,130 B2
(45) Date of Patent: Apr. 28, 2020

(54) COMPACT VOICE COIL DRIVEN HIGH FLOW FLUID PUMPS AND METHODS

(71) Applicant: Sung Won Moon, Phoenix, AZ (US)

(72) Inventor: Sung Won Moon, Phoenix, AZ (US)

( * ) Notice: Subject to any disclaimer, the term of this patent is extended or adjusted under 35 U.S.C. 154(b) by 424 days.

(21) Appl. No.: 15/258,946

(22) Filed: Sep. 7, 2016

(65) Prior Publication Data

US 2018/0209408 A1 Jul. 26, 2018

(51) Int. Cl.

| | |
|---|---|
| ***F04B 43/04*** | (2006.01) |
| ***F04B 45/047*** | (2006.01) |
| ***F04B 39/12*** | (2006.01) |
| ***F04B 53/10*** | (2006.01) |
| ***F04B 53/08*** | (2006.01) |
| ***F04B 39/00*** | (2006.01) |
| ***F04B 43/02*** | (2006.01) |

(52) U.S. Cl.

CPC ..... *F04B 43/04* (2013.01); *F04B 39/0027* (2013.01); *F04B 39/121* (2013.01); *F04B 43/025* (2013.01); *F04B 45/047* (2013.01); *F04B 53/08* (2013.01); *F04B 53/10* (2013.01)

(58) Field of Classification Search

CPC ..... F04B 43/04; F04B 45/047; F04B 53/10; F04B 35/04; F04B 43/025; F04B 43/046; F04B 39/0027; F04B 39/121; F04B 53/08; F04B 53/16; F04B 49/225; F04F 7/00; G06F 1/20; G06F 1/203

See application file for complete search history.

(56) References Cited

U.S. PATENT DOCUMENTS

| | | | | |
|---|---|---|---|---|
| 4,751,437 A * | 6/1988 | Gerard | H01J 23/20 | 310/13 |
| 6,203,291 B1 * | 3/2001 | Stemme | F04B 43/043 | 137/833 |
| 6,542,617 B1 * | 4/2003 | Fujihira | H04R 9/04 | 381/402 |

(Continued)

FOREIGN PATENT DOCUMENTS

| | | |
|---|---|---|
| RU | 122452 | 11/2012 |
| WO | 2006111775 | 10/2006 |
| WO | 2010139918 | 12/2010 |

OTHER PUBLICATIONS

HowStuffWorks.com Contributors "What's a voice coil on a speaker?" Jul. 27, 2011.HowStuffWorks.com. (Year: 2011).*

*Primary Examiner* — Patrick Hamo
*Assistant Examiner* — David N Brandt
(74) *Attorney, Agent, or Firm* — Booth Udall Fuller, PLC

(57) ABSTRACT

A fluid pump is disclosed with a fluid pump housing, a first pole piece having a first polarity and positioned within the fluid pump housing, an opposing pole piece having a second polarity different from the first polarity, positioned within the fluid pump housing and spaced from the first pole piece, a wire coil comprising a coiled electrically conductive wire comprising a first end and a second end, the wire coil movably positioned between the first pole piece and the opposing pole piece, at least one membrane coupled between the fluid pump housing and the wire coil, the membrane configured to move responsive movement of the wire coil through elongation of a membrane suspension section, and at least one vent extending through a wall of the fluid pump housing to an fluid chamber immediately adjacent to the at least one membrane.

14 Claims, 14 Drawing Sheets

(56) References Cited

U.S. PATENT DOCUMENTS

| | | | | |
|---|---|---|---|---|
| 7,936,896 | B2 * | 5/2011 | Horigome | H04R 7/16<br>361/690 |
| 2004/0000843 | A1 * | 1/2004 | East | F04B 43/046<br>310/331 |
| 2006/0281398 | A1 * | 12/2006 | Yokomizo | G06F 1/203<br>454/184 |
| 2011/0076170 | A1 * | 3/2011 | Fujisaki | F04B 45/047<br>417/415 |
| 2015/0078934 | A1 * | 3/2015 | Lucas | F04B 43/0054<br>417/413.1 |
| 2017/0002839 | A1 * | 1/2017 | Bukland | F04B 43/046 |

* cited by examiner

COMPACT VOICE COIL DRIVEN HIGH FLOW FLUID PUMPS AND METHODS

TECHNICAL FIELD

The disclosure relates to an apparatus and method for pumping or otherwise moving fluids. More specifically, this disclosure relates to an apparatus and method for pumping or otherwise moving fluids where there may be limited physical space available.

BACKGROUND

A major problem faced in electronics today is providing efficient heat dissipation for high performance electronic devices and systems including, but not limited to, sensors, integrated circuit boards, semiconductor chips, memory, microprocessors, cellular phones, ultra mobile personal computers ("UMPCs"), notebook personal computers, desktop personal computers, and blade servers, especially when space constraints are imposed in such applications. As additional features are added to such systems and devices, such features consume more power, while the systems and devices become smaller and thinner and generally have more limited size and space constraints. As a result, the power density of such systems and devices increase, resulting in significant temperature increases, which may lead to a deterioration of the performance and/or reliability of the system or device, as well as the overall user experience.

Fans, blowers and heat sinks are typically used in such applications to dissipate heat. However, there is no fan, blower or heat sink technology available which presently fulfills the performance, size and space limitations of today's increasingly smaller systems and devices. In fact, the performance of current fans or blowers generally significantly decreases as z-height decreases. To date, options for cooling electronic systems and devices with ever decreasing geometries have been very limited, and have presented significant challenges to designers of electronic systems and devices due, in large part, to the limited capability of known convection cooling technologies. Thus, the design of such systems and devices has been greatly limited as: i) the functionality and features for a given system or device has increased; and ii) the overall size and shape of such systems and devices has decreased.

Conventional smart phone technologies rely upon only natural convection and conductive heat dispersion for cooling. Handheld PC's rely on either natural convection/conduction, or on relatively weak convection. In both instances, practical design, performance and functionally are greatly limited by the cooling capacity of such systems and devices.

SUMMARY

According to an aspect of the disclosure, a fluid pump may comprise a fluid pump housing, a first pole piece having a first polarity and positioned within the fluid pump housing, an opposing pole piece having a second polarity different from the first polarity, positioned within the fluid pump housing and spaced from the first pole piece, a wire coil comprising an electrically conductive wire comprising a first end and a second end, the wire coil movably positioned between the first pole piece and the opposing pole piece, at least one membrane coupled between the fluid pump housing and the wire coil, a membrane suspension section surrounding the membrane, the membrane configured to move responsive movement of the wire coil by elongating the membrane suspension section, and at least one vent extending through a wall of the fluid pump housing to an fluid chamber immediately adjacent to the at least one membrane, wherein the fluid pump is configured such that application of a current through the coiled wire creates an electro-magnetic field that reacts to a field extending between the first pole piece and the opposing pole piece and causes the wire coil to move in relation to the first pole piece and the opposing pole piece to move the membrane to pump fluid into or out of the at least one vent.

Particular embodiments may comprise one or more of the following. A circular magnet positioned within the housing and in magnetic contact with the opposing pole piece. The circular magnet may be a ring magnet positioned to surround at least a portion of the wire coil, and the opposing pole piece is folded over an edge of the circular magnet and is in contact with at least two adjacent sides of the circular magnet. The ring magnet may comprise a modular ring magnet comprising one or more smaller magnets arranged in a ring configuration. The circular magnet may be a center magnet having a portion surrounded by a portion of the wire coil, and the opposing pole piece is folded over an edge of the circular magnet and is in contact with at least two adjacent sides of the circular magnet. The at least one vent may comprise a check valve directly coupled to and in fluid communication with the at least one vent. The fluid pump housing may comprise an outer diameter between 25 mm to 80 mm and a height of between 6 mm to 25 mm. The membrane may be formed of at least one of a metal and a polymer. The membrane suspension section may comprise a plurality of spokes extending between the at least one membrane coupled to the wire coil and a membrane outer ring coupled to the fluid pump housing. An additional polymer seal formed over the plurality of spokes. The at least one vent may comprise at least two vents on opposing surfaces of the fluid pump housing. The opposing surfaces of the fluid pump housing may comprise a top surface and a bottom surface of the fluid pump housing or opposing side wall surfaces of the fluid pump housing. The at least one vent may comprise at least two vents on adjacent surfaces of the fluid pump housing.

The first pole piece, the opposing pole piece, the wire coil and the at least one membrane may be within the fluid pump housing at a top end of the fluid pump housing, and the fluid pump may further comprise a second pole piece having the first polarity and positioned within the fluid pump housing, a second opposing pole piece having the second polarity positioned within the fluid pump housing and spaced from the second pole piece, a second wire coil comprising a second coiled electrically conductive wire, the second wire coil movably positioned between the second pole piece and the second opposing pole piece, and at least a second membrane coupled between the fluid pump housing and the second wire coil responsive to movement of the second wire coil, wherein the second pole piece, the second opposing pole piece, the second wire coil and the at least a second membrane are within the fluid pump housing at a bottom end of the fluid pump housing, opposite the top end.

The at least one vent may comprise a first vent and a second vent each extending through different sides of the fluid pump housing in fluid communication with the fluid chamber within the fluid pump. The at least one vent may further comprise a third vent and a fourth vent each extending through different sides of the fluid pump housing in fluid communication with a second fluid chamber within the fluid pump, the second fluid chamber immediately adjacent to the at least a second membrane. The fluid chamber and the second fluid chamber may be separate such that a first fluid flow path through the fluid pump is established through the first vent, second vent and fluid chamber, and a second fluid flow path through the fluid pump, separate from the fluid flow path, is established through the third vent, fourth vent and second fluid chamber. A supporting ring magnet may sits between the first pole piece and the opposing pole piece, the opposing pole piece is folded over an edge of the supporting ring magnet, the wire coil surrounds a portion of the first pole piece and the membrane covers a portion of the first pole piece, and the at least one vent comprises a first vent entering the fluid pump housing through a first side wall of the fluid pump housing and a second vent entering through a second side wall of the fluid pump housing. A center supporting magnet may have a first surface covered by the first pole piece and is at least partially surrounded by the opposing pole piece, the wire coil surrounds a portion of the second pole piece and the membrane is positioned adjacent to and movable in relation to the second pole piece. The opposing pole piece may be folded over an edge of the center supporting magnet. The at least one vent may comprise a first vent entering the fluid pump housing through a first side wall of the fluid pump housing and a second vent entering through a top wall of the fluid pump housing. The at least one vent may comprise a first vent entering the fluid pump housing through a top wall of the fluid pump housing and a second vent entering the fluid pump housing through a bottom wall of the fluid pump housing. The opposing pole piece may be folded over an edge of a magnet positioned between the first pole piece and the opposing pole piece. The fluid pump may comprise a system of fluid pumps each comprising its own first pole piece, opposing pole piece, wire coil, membrane, at least one vent and fluid chamber as recited in claim 1. The wire coil may be a voice coil.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

FIG. 11 depicts a cross-sectional side view of a fluid pump having a first pole center core magnet, a second pole supporting magnet and a ring magnet in between.

FIG. 12 depicts a cross-sectional side view of a fluid pump having an outer pole piece, a second inner pole piece and a core magnet in between.

FIG. 15 depicts a cross-sectional perspective view of a fluid pump having a two membranes and two voice coils with the fluid nozzle in between.

DETAILED DESCRIPTION

Figure 1A:
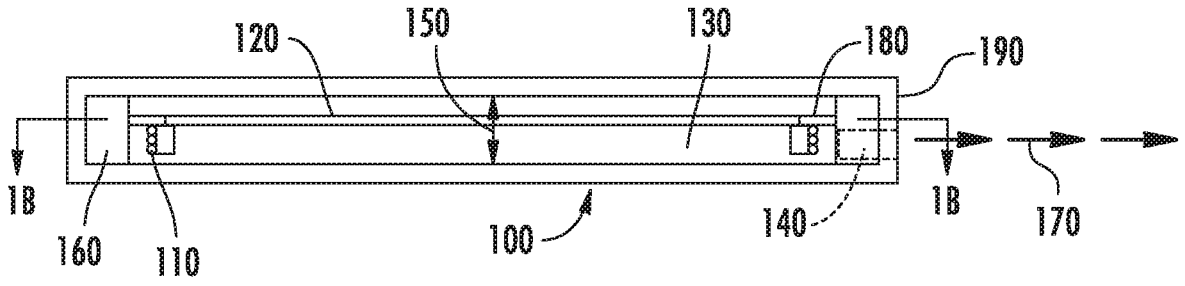
FIG. 1A depicts a cross-sectional side view of a fluid pump.

The present disclosure includes a description of one or more aspects or embodiments with reference to the Figures, in which like numerals represent the same or similar elements. In the description, numerous specific details are set forth, such as specific configurations, compositions, and processes, etc., in order to provide a thorough understanding of the disclosure. In other instances, well-known processes and manufacturing techniques have not been described in particular detail in order to not unnecessarily obscure the disclosure. Furthermore, the various embodiments shown in the Figures are illustrative representations and are not necessarily drawn to scale.

This disclosure, its aspects and implementations, are not limited to the specific equipment, material types, or other system component examples, or methods disclosed herein. Many additional components, manufacturing and assembly procedures known in the art consistent with this disclosure are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

Where the following examples, embodiments and implementations reference examples, it should be understood by those of ordinary skill in the art that other manufacturing devices and examples could be intermixed or substituted with those provided. In places where the description above refers to particular embodiments, it should be readily apparent that a number of modifications may be made without departing from the spirit thereof and that these embodiments and implementations may be applied to other technologies as well. Accordingly, the disclosed subject matter is intended to embrace all such alterations, modifications and variations that fall within the spirit and scope of the disclosure and the knowledge of one of ordinary skill in the art.

A voice coil is a coil of wire that is typically attached to the apex of a loudspeaker cone that provides force to move the loudspeaker cone through reaction of a magnetic field to the current passing through the voice coil. Voice coils are also known to assist in moving the heads inside hard disk drives. For a voice coil, a greater magnetic force causes a greater magnitude of physical movement, and a lower magnetic force causes a lower magnitude of physical movement. Driving current through a voice coil produces a magnetic field about the wires of the voice coil. The magnetic field causes the voice coil to react from a magnetic field from a permanent magnet that is fixed nearby. By changing the polarity of the current flowing through the voice coil wires, the polarity of the magnetic field generated is changed. Metallic wire, such as copper, silver, aluminum, anodized aluminum and the like.

Although use of a conventional voice coil would not provide the force needed to move the fluid required for applications of the voice coil pumps relevant to this disclosure, the modifications to pump structure that involve a voice coil as illustrated and explained throughout this disclosure form useful, small, powerful pumps that each include a voice coil component. It is desirable to form a fluid pump with the mechanical force necessary to move a voice coil and membrane, but also with advantageous electrical efficiency for minimal power consumption. The mechanical force needed to move voice coil/membrane combinations in embodiments of this disclosure is proportional to: 1) the electrical current through the voice coil; and 2) the length of the voice coil wire. Thus, the longer the voice coil wire, the more powerful the force available to move the voice coil at a given electrical current. Additionally, the mechanical force at a given electrical current is highest at the resonant frequency of the moving mechanism (the voice coil/membrane combination—the mass) and the mechanical suspension (the spring). Electrical power consumption is the product of: 1) I^2, the square of the electrical current through the voice coil; and 2) R, the electrical resistance of the voice coil. Thus, to minimize power consumption, the electrical resistance of the voice coil should be as low as possible for a given length.

The specific number of wire winds is not critical to the design, but the higher the number of winds the better for increasing the length of the voice coil wire and thus the mechanical force available to move the voice coil/membrane. Those of ordinary skill in the art will understand how to balance the available space restraints with the desire for a longer wire using the principles disclosed herein to obtain an appropriate wire length for each particular implementation. Similarly, the coil wire type is not critical, but because lowest electrical resistance is better to minimize power consumption, low electrical resistance materials such as silver and copper tend to work better. However, since copper typically only has approximately 5% higher electrical resistance than silver and is much cheaper, copper is the practical choice for coil wire materials. In particular embodiments, copper magnet wire, which is copper wire pre-treated with a thin electrical insulation coating, is used. Other materials known for their conductive properties, may also be used. The specific frequency of the oscillating signal used to provide the current for the voice coil is not critical, but selection of a frequency within the range of 40 to 100 Hz has been found to most closely approximate the resonant frequency of the particular voice coil/membrane combinations described in association with embodiments of this disclosure.

Figure 1B:
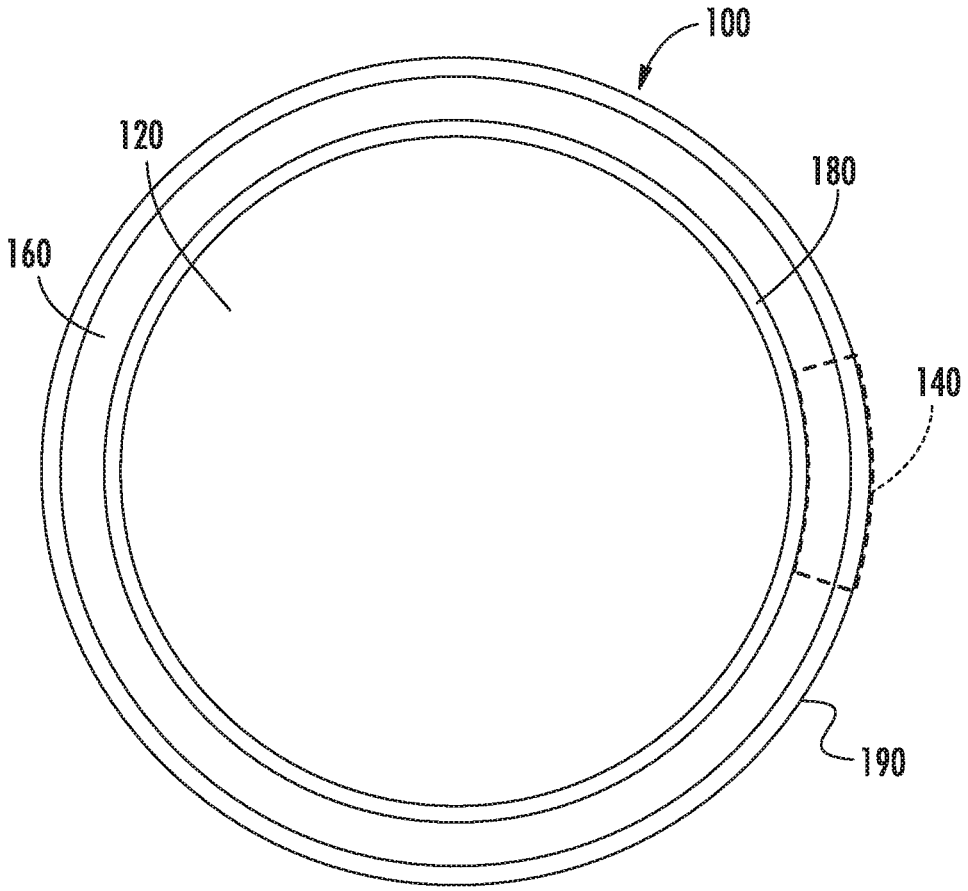
FIG. 1B depicts a top plan view through section 1B-1B of the fluid pump of FIG. 1A.

FIGS. 1A and 1B depict one embodiment of the instant disclosure. FIG. 1A depicts a cross-sectional view of fluid pump 100 comprising a voice coil 110, a membrane 120, a fluid chamber 130, and a ring magnet 160. The ring magnet is any magnet, such as a toroidal- or donut-shaped magnet, or plurality of magnet sections arranged with an opening in the middle. The mechanical force to cause the voice coil to move is proportional to the magnetic field applied to the voice coil, which is proportional to the magnetic strength of the magnet used. Thus, for highest pumping power, the highest magnetic strength per volume and weight is desirable. Rare earth magnets are generally considered to have the highest magnetic strength per volume and weight. In particular embodiments, Neodynium magnets grade 50, 51 or 52 may be used as the magnet for various implementations of the embodiments described throughout this disclosure.

Voice coil 110 is driven by the nearby ring magnet 160. When an electronic current is applied to voice coil 110, it induces motion in the associated membrane 120. When the polarity of the current changes, it induces opposite motion in the associated membrane due to the movement of ring magnet 160. Membrane 120 is held in place by an elastic component or surround 180. The Z-direction displacement of the membrane 120 (represented by movement arrows 150) causes the fluid chamber 130 to push away from its center. This pushing leads to pressurized fluid flow 170 through the nozzle opening 140.

FIG. 1B depicts a top plan view through section 1B-1B of FIG. 1A, illustrating the connection of membrane 120 to fluid pump 100 via an elastic component or surround 180, which may either tether membrane 120 to ring magnet 160 or to the inside diameter of outer housing 190, and allows membrane 120 a greater range of motion or displacement 150 than if membrane 120 is directly stretched over or attached to an outer edge of housing 190. In this embodiment, ring magnet 160 is attached to outer housing 190. Also in this embodiment, nozzle opening 140 may be on a different xy-plane than membrane 120. In addition, fluid pump 100 may comprise one or more nozzles 140, each of which may be configured in various sizes, shapes and be placed in different locations to suit the design and/or performance requirements of the fluid pump 100.

Figure 2:
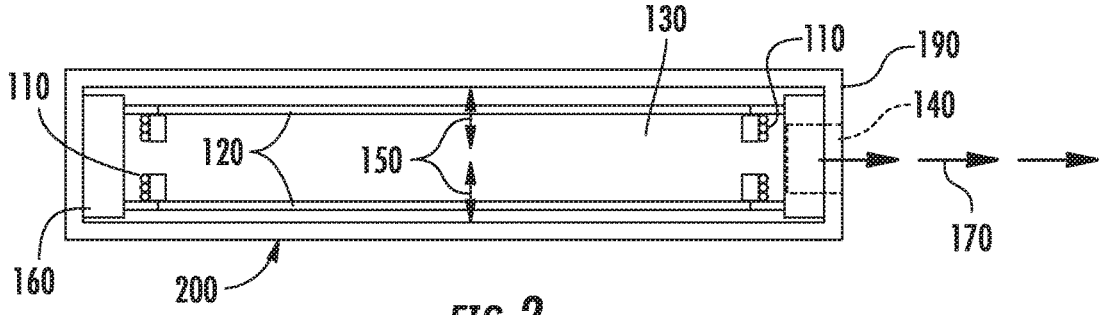
FIG. 2 depicts a cross-sectional side view of a fluid pump having two membranes on opposing ends of the fluid chamber.

FIG. 2 illustrates a fluid pump 200 comprising two membranes 120 located on opposing ends of fluid chamber 130. This fluid pump embodiment comprises two opposing sets of voice coils 110, a fluid chamber 130, and a ring magnet 160. The operation of this embodiment is similar to the embodiment of FIG. 1, wherein voice coils 110 induce membranes 120 to oscillate in z-direction 150. Membranes 120 are each located on substantially opposing ends of fluid chamber 130, referred to herein as top and bottom ends of fluid chamber 130. Membranes 120 vibrate out of phase, either both moving substantially simultaneously inward, or both moving substantially simultaneously outward. This symmetrical arrangement tends to cancel the vibration induced by a single membrane 120, resulting in noise canceling, while still providing fluid flow (represented by arrows 170) through nozzle opening 140.

Figure 3:
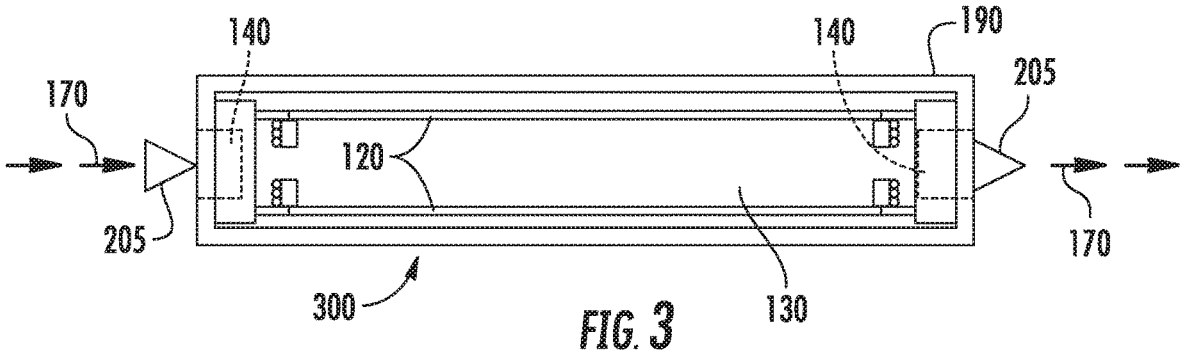
FIG. 3 depicts a cross-sectional side view of a fluid pump having multiple nozzle openings containing check valves to direct fluid flow downstream.

FIG. 3 illustrates a fluid pump 300 comprising check valves 205 to regulate flow 170. The fluid pump 300 comprises two nozzle openings 140 on opposing ends of the fluid pump 300, each nozzle opening 140 having a check valve 205 configured to regulate flow 170 by ensuring that the fluid flows in a substantially single direction, providing an upstream to downstream fluid flow 170, rather than allowing flow 170 out of both nozzle 140 openings. Check valves 205 may be placed at the nozzle openings 140 of any embodiment described or shown herein to direct and control flow 170 in a specific or desired direction.

Figure 4:
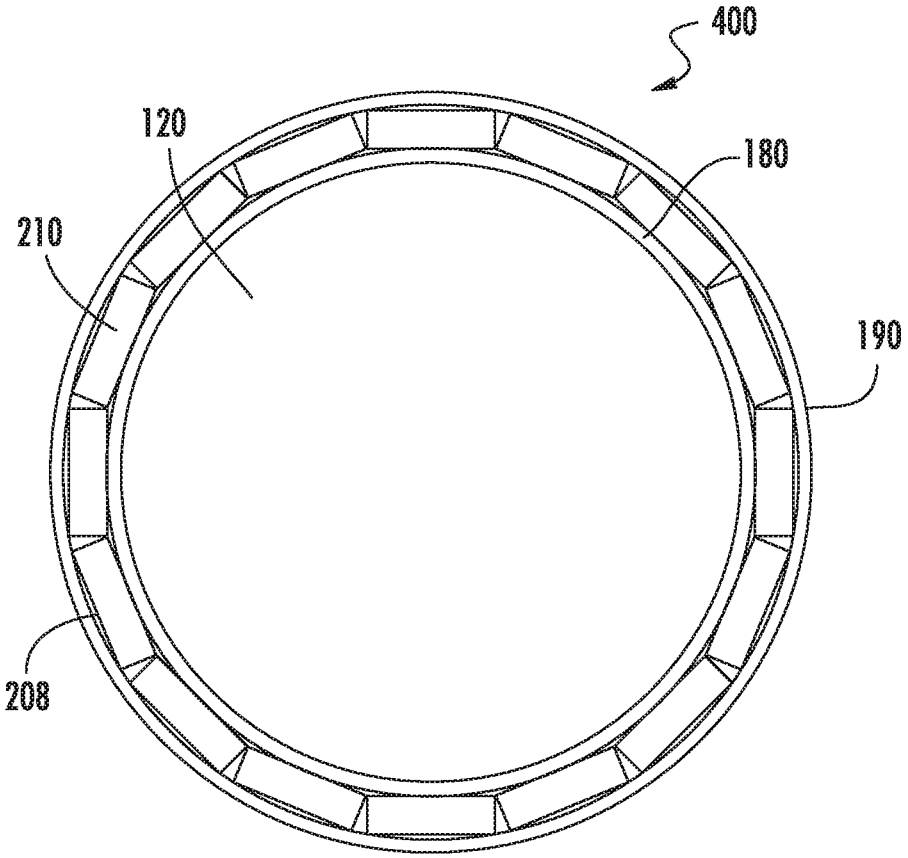
FIG. 4 depicts a top plan view of a fluid pump having a magnet ring formed of a plurality of magnet sections.

FIG. 4 illustrates a fluid pump 400 depicting that the ring magnet 208 may comprise a plurality of magnet segments 210 in place of a solid body ring magnet. Alternatively, it may be formed as a solid body ring magnet. The elastic component or surround 180 assists in maintaining membrane 120 in position, and ring magnet 208 separates membrane 120 from housing 190. Shapes, locations, and the number of magnet segments 210 may vary to form magnet ring 208 based upon specific design specifications or requirements.

Figure 5:
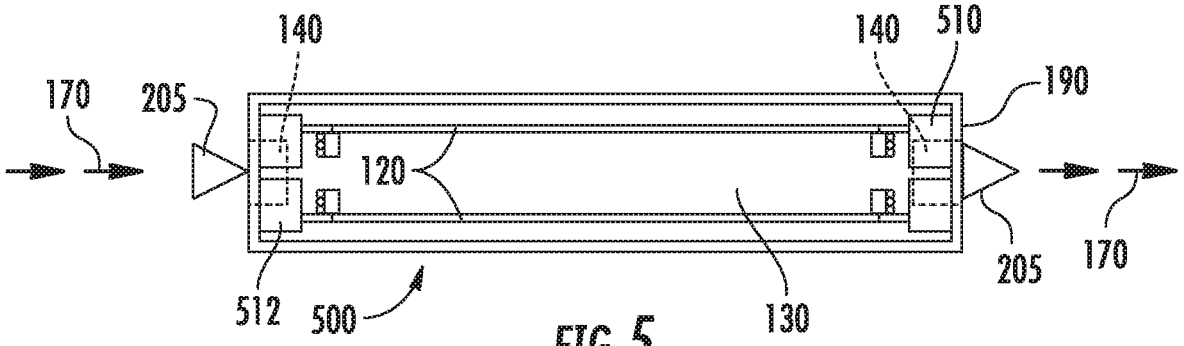
FIG. 5 depicts a cross-sectional side view of a fluid pump having a magnet ring formed as top and bottom halves.

FIG. 5 illustrates a fluid pump 500 comprising a magnet ring 510, 512 may be separated into top 510 and bottom 512 halves. Instead of having nozzle openings 140 extend through magnet ring 510, 512, the spacing of the top and bottom portions of the ring 510, 512 may provide for nozzle openings 140 therethrough. Alternatively, or additionally, nozzle openings 140 may be positioned as depicted in FIGS. 1A and 1B and/or FIG. 3. This configuration of nozzle openings 140 may vary in size, shape, location and number to meet desired performance specifications. Nozzle openings 140 may also accommodate check valves 205 to provide a desired directional fluid flow 170.

Figure 6A:
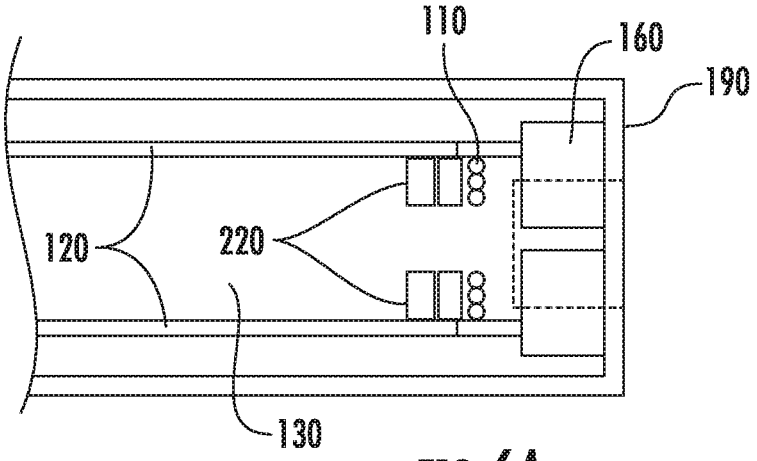
FIG. 6A depicts a cross-sectional side view of a fluid pump having an inner magnet ring attached to the back side of the voice coil.
Figure 6B:
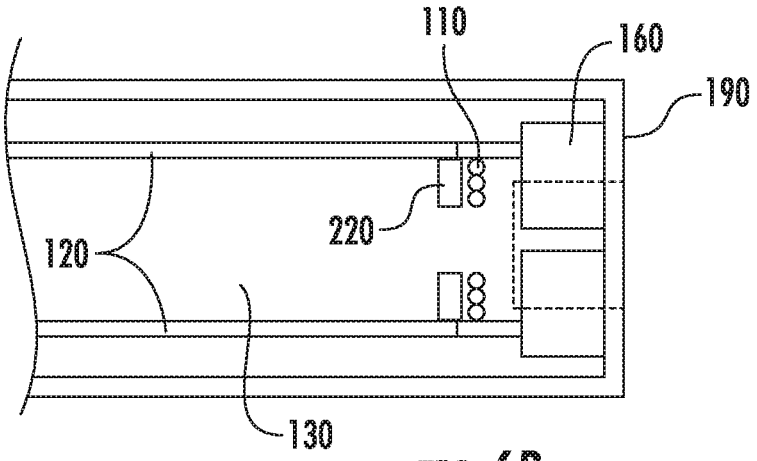
FIG. 6B depicts a cross-sectional side view of a fluid pump having a voice coil rim formed of a magnetic material.

FIGS. 6A and 6B illustrate alternate embodiments of voice coil 110 assemblies incorporating inner ring magnets 220 in addition to outer ring magnets 160 to enhance the magnetic field. FIG. 6A illustrates that an inner magnet ring 220 may be coupled to the back side of the voice coil 110. FIG. 6B illustrates that the structure for the voice coil 110 rim itself comprises the inner magnet ring 220.

Figure 7:
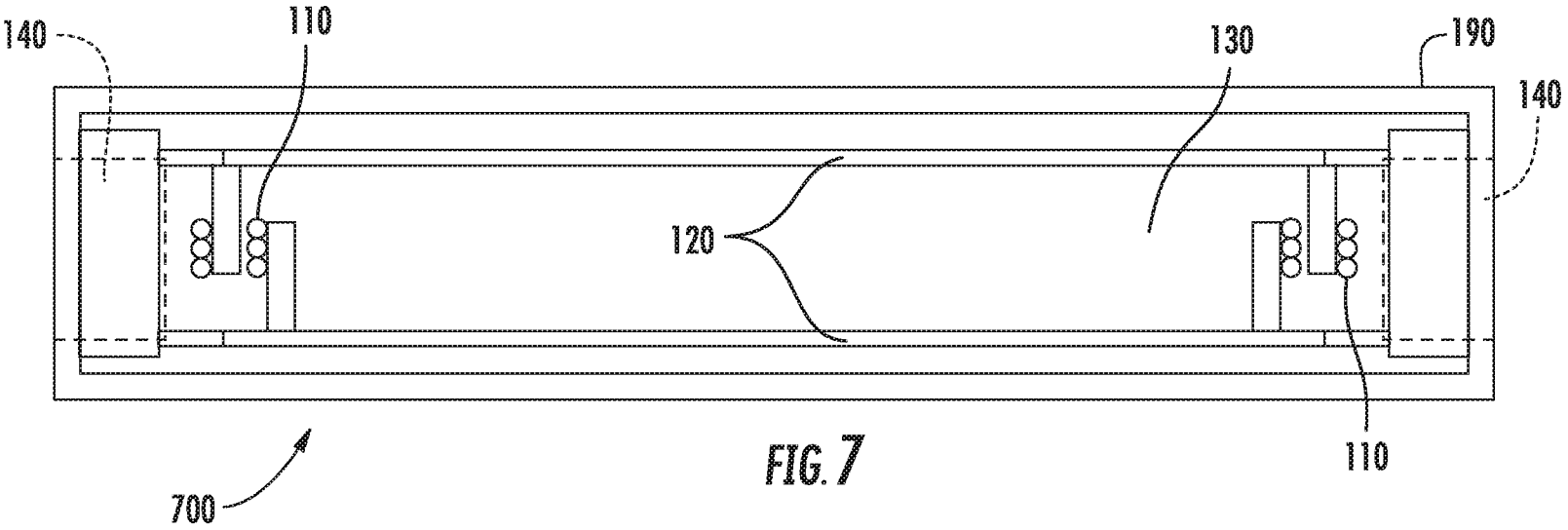
FIG. 7 depicts a cross-sectional side view of a fluid pump having overlapping voice coils.

FIG. 7 illustrates a fluid pump 700 comprising overlapping voice coils 110 and allows membranes 120 to be closer together, proportionally reducing the volume of fluid chamber 130 and nozzle opening 140. This configuration of voice coil 110 and the magnet assembly may vary depending on desired design and performance requirements.

Figure 8A:
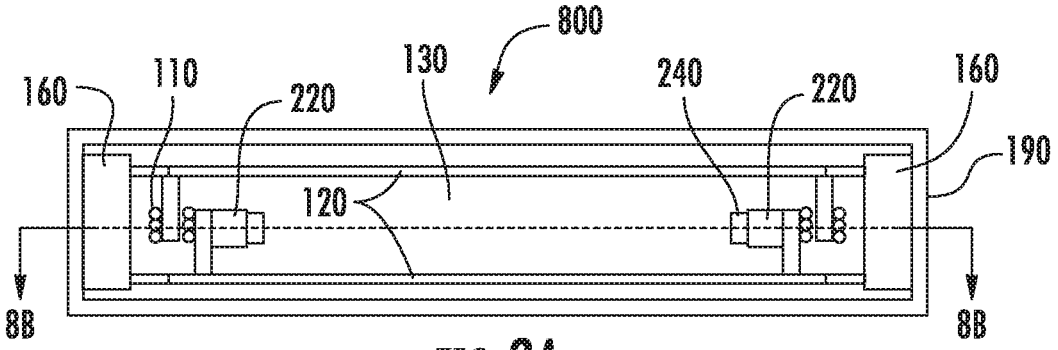
FIG. 8A depicts a cross-sectional side view of a fluid pump having overlapping voice coils and inner and outer magnetic rings.
Figure 8B:
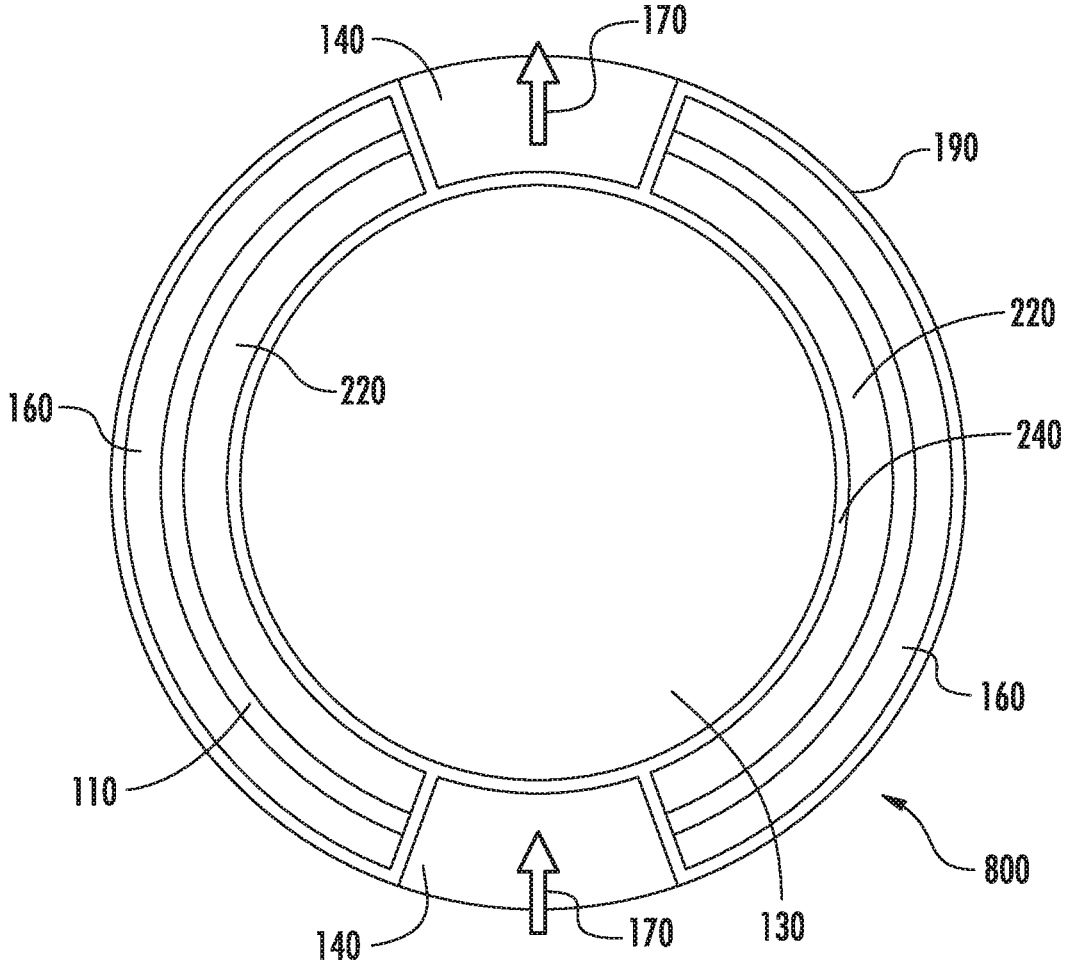
FIG. 8B depicts a sectional top plan view of the fluid pump of FIG. 8A.

FIGS. 8A and 8B illustrate, respectively, cross-sectional and top-down views of a fluid pump 800. The fluid pump 800 comprises an inner ring magnet 220, like that illustrated in the fluid pump of FIG. 6, and overlapping voice coils 110 as illustrated in FIG. 7. In this embodiment, the voice coils 110 are bounded on opposing sides by outer ring magnet 160 and inner ring magnet 220, with inner ring magnet 220 being held in place by a support 240.

Figure 9:
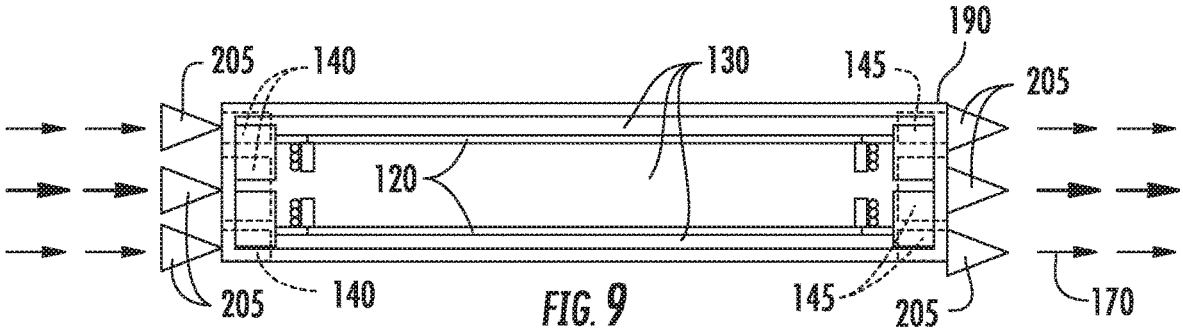
FIG. 9 depicts a cross-sectional side view of a fluid pump having multiple nozzle openings with check valves.

FIG. 9 illustrates an embodiment of the housing of the instant invention 100 having multiple nozzle openings 145 to provide additional fluid flow 170. Fluid 170 enters fluid chamber 130 by passing through check valve 205 through a single nozzle opening 140. After fluid 170 is driven by oscillating membranes 120, fluid 170 is forced out of fluid chamber 130 through multiple nozzle openings 145.

The strength or velocity of fluid flow 170 from any particular nozzle opening 140, 145 is generally dependent upon the shape, location, and/or number of openings 140, 145, as well as the use or non-use of check valves 205 in connection with one or more nozzle openings 140 and/or 145. Shapes, locations, and the number of openings 140 and 145 may vary depending upon design and/or performance requirements, and the use of check valves 205 may further vary the requirements and characteristics of fluid flow 170 through apparatus 100.

Figure 10:
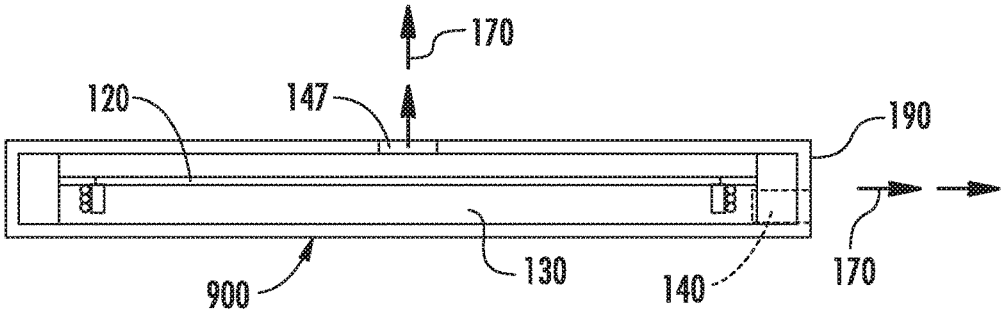
FIG. 10 depicts a cross-sectional side view of a fluid pump having a nozzle opening in a top surface of the fluid pump.

FIG. 10 also illustrates a fluid pump 900 comprising the incorporation of multiple nozzle openings in varying directions. In the embodiment depicted in FIG. 10, lateral nozzle opening 147 may be located on the top or bottom surface of the housing of the fluid pump 900, in conjunction with the standard nozzle opening 140. Standard nozzle opening 140 may be adjusted or completely closed depending on the design or performance requirements of a particular embodiment of a fluid pump 900. In addition or alternatively, the size, shape, location, and number of lateral openings 147 may also vary depending upon design and/or performance requirements of a particular fluid pump 900 embodiment or application. In addition, check valves may also be utilized in connection with one or more of nozzle openings 140 and 147 in order to control fluid flow 170.

Although various Figures throughout this disclosure show fluid flow arrows 170 oriented in a particular direction in relation to the nozzle openings 140, 145, 147, it should be clear to those of ordinary skill in the art that the direction of flow will vary depending upon whether the voice coil membranes are compressing or expanding the fluid chamber 130 and whether there is a check valve 205 located at the particular nozzle opening 140, 145, 147 to regulate direction of flow.

Particular embodiments of the present disclosure, including each of the embodiments illustrated in FIGS. 11-15, employ an opposing pole piece 113, 113*a*, 113*b*, 123 that is folded or continued around an edge (i.e. top to side or bottom to side) of a magnet 129, 160 within the housing 116, 126. If a thin, flat pole piece were used, the magnetic gap would be small, only a small portion of the voice coil would be exposed to the magnetic flux and the membrane would only travel over a small distance resulting in shorter liner pump movement and lower fluid flow per pump. If a thicker, flat pole piece were used, the magnetic gap would be large, a larger amount of voice coil would be exposed to the magnetic flux and the membrane could potentially travel over a larger distance, but this would also necessarily increase the thickness of the pump (to accommodate the larger pole plate) and increase the weight of the pump. By folding the opposing pole piece 113, 113*a*, 113*b*, 123 so that it exists on two separate, adjacent sides of the magnet 129, 160 within the housing 116, 126, the magnetic gap becomes large, exposing the voice coil 114, 114*a*, 114*b*, 124 to a greater height of magnetic flux without an increased pump housing thickness or weight for a particular, desired linear membrane movement and pump flow volume. This principle may be applied to any of the implementations disclosed herein. The height of the opposing pole piece along the side of the magnet can be determined based on the desired linear movement of the membrane, the elasticity and stiffness of the membrane suspension portion and other characteristics of the particular design into which this principle is applied. Those of ordinary skill in the art will readily be able to choose appropriate opposing pole piece dimensions and characteristics for a particular pump design.

Figure 11:
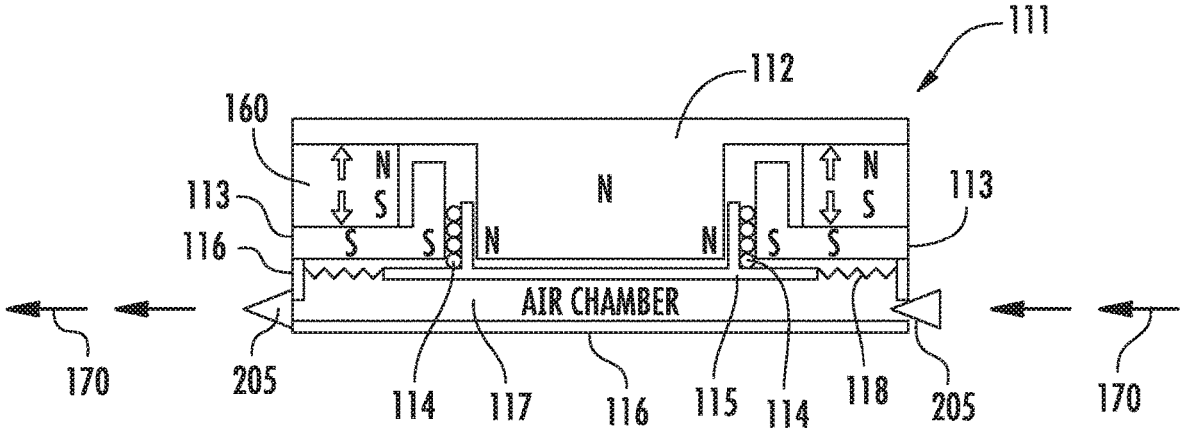

FIG. 11 illustrates a fluid pump 111 comprising a first pole, center core pole piece 112, a supporting ring magnet 160, a second pole piece formed as a ring forming an opposing pole piece 113, a voice coil 114 coupled to a membrane 115 that is suspended from the fluid pump housing 116 by a suspension connector 118 that may be part of the membrane 115. The pole pieces are formed of materials with high magnetic permeability, such as mild steel, soft iron and permendur. When a pole piece is attached to a North or South pole of a magnet, the pole piece effectively extends the pole of the magnet. By forming the pole pieces into a desired shape, the magnetic field can be directed advantageously.

The membrane 115, as with other membranes disclosed herein, may be formed of a metal, such as aluminum, or polymer material, such as rubber. The membrane suspension portion should have some elasticity and bias the membrane back to a relaxed position. Non-limiting examples of materials that can be formed to bias back to a relaxed position include, a light metal such as aluminum, rubber or other polymer, elastomeric silicone film, Kevlar, fiberglass, carbon fiber, or some other flexible polymer that suspends the membrane with the membrane suspension portion so that the membrane position can be moved between a relaxed and an extended position to allow for oscillating movement of the voice coil between the first pole piece 112 and the opposing pole piece 113 to enlarge and reduce the fluid chamber 117 volume. In particular implementations, the range of travel for the membrane provided by the suspension portion surrounding the membrane is 1 mm to 3 mm of linear movement within the housing. To do this, the suspension portion between the outer ring of the membrane and the center membrane includes sufficient compliance to enable this movement. The suspension portion ideally also has sufficient stiffness to enable a higher resonance frequency according to the equation $$\omega = \sqrt{\frac{k}{m}},$$

where ω is the resonant frequency, k is the spring stiffness, and m is the moving mass of the membrane. The resonance frequency is the frequency at which the membrane travel distance is the highest per given electrical input. The higher this resonant frequency, the greater the fluid flow generated for the fluid pump.

Examples of such a structure are shown and described with reference to FIGS. 18A and 18B, herein. As applied to the embodiment shown in FIG. 11, the first pole piece 112 has a first polarity, N, and the opposing pole piece 113 has a second, opposite, polarity, S, to oppose the first pole piece 112. The supporting ring magnet 160 sits between the first pole piece 112 and the opposing pole piece 113. In this particular embodiment, vents 140 with check valves 205 are provided at opposing sides of the fluid pump 111 to allow fluid to move into and out of the fluid chamber 117, as illustrated by fluid flow directional arrows 170.

Figure 12:
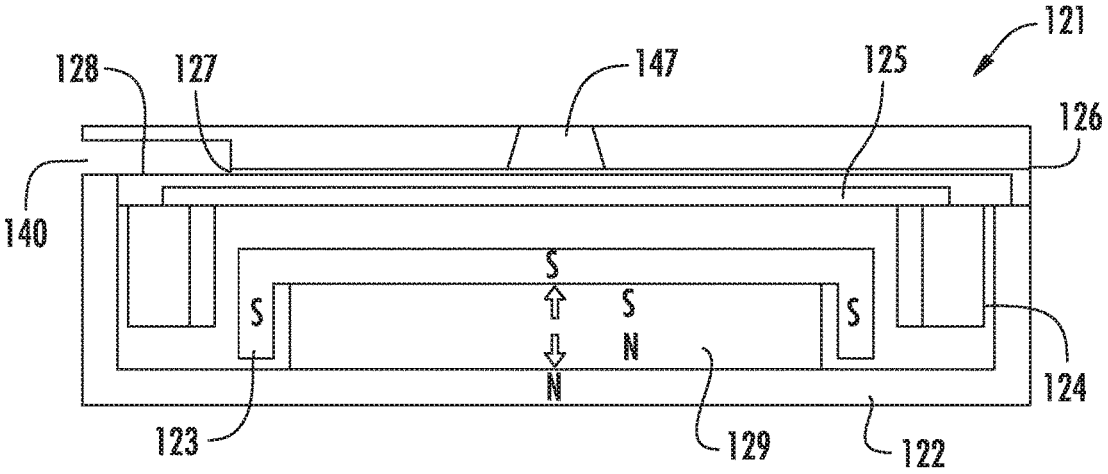

FIG. 12 illustrates a fluid pump 121 comprising a first overlay pole piece 122, a supporting magnet 129, a second, opposing pole piece 123, a voice coil 124 coupled to a membrane 125 that is suspended from the fluid pump housing 126 by a suspension connector 128 that may be part of the membrane 125. The membrane 125, allows for oscillating movement of the voice coil 124 to move the voice coil 124 up and down between the first pole piece 122 and the opposing pole piece 123 to enlarge and reduce the fluid chamber 127 volume. As applied to the embodiment shown in FIG. 12, the first pole piece 122 has a first polarity, N, and the opposing pole piece 123 has a second, opposite, polarity, S, to oppose the first pole piece 122. The supporting magnet 129 sits between the first pole piece 122 and the opposing pole piece 123. In this particular embodiment, a side vent 140 and a top vent 147 are provided through the respective side wall and top cap of the fluid pump housing 126. Although not illustrated in this particular embodiment, as with any of the embodiments described herein, check valves may be included on one or more of the vents 140, 147 to regulate the direction of fluid flow into and out of the pump.

Figure 13A:
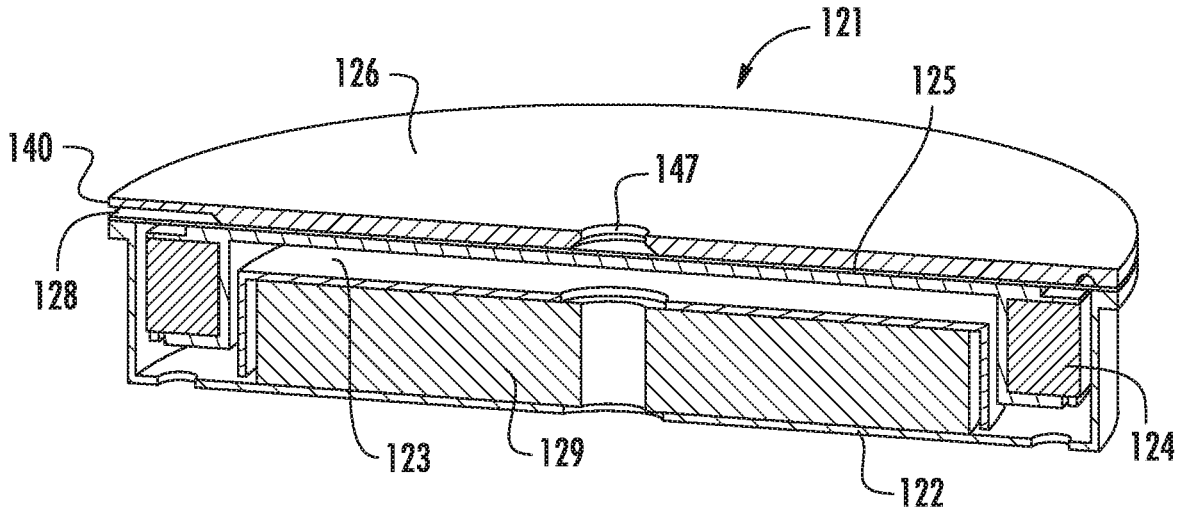
FIG. 13A depicts a cross-sectional perspective view of a fluid pump having the magnet configuration as depicted in FIG. 12 showing the membrane in the relaxed position.
Figure 13B:
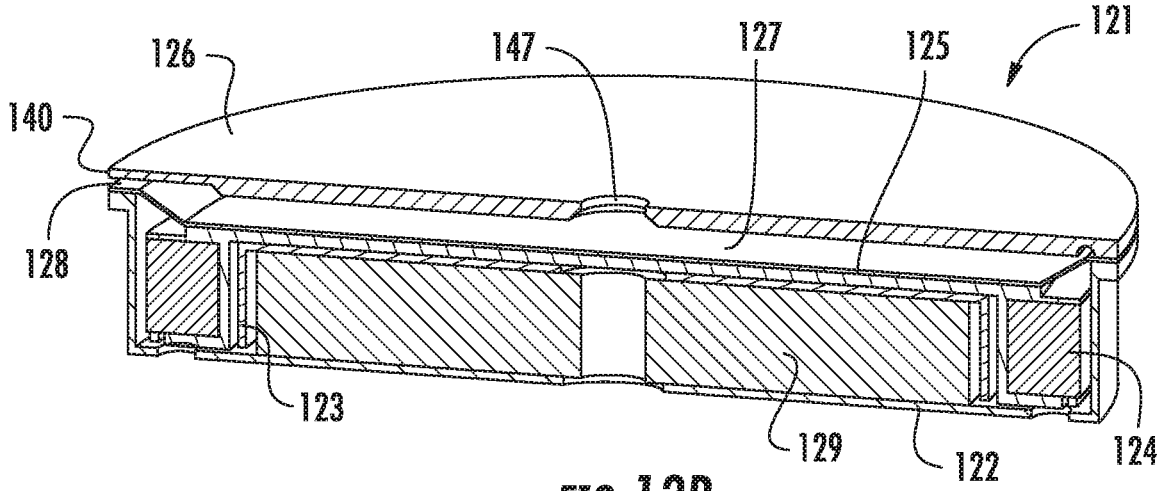
FIG. 13B depicts a cross-sectional perspective view of a fluid pump having the magnet configuration as depicted in FIG. 12 showing the membrane in the extended position.

FIGS. 13A and 13B illustrate, respectively, a cross-sectional perspective view of the fluid pump embodiment of FIG. 12 with the membrane 125 in the relaxed (13A) and extended (13B) positions. The fluid chamber 127 is disposed between the suspension member 128 and the top cap of the fluid pump housing 126. With this embodiment, as with any other embodiment disclosed herein, including the embodiments with multiple side vents 145 (FIG. 9), depending upon how one or more check valves are disposed on the side vent 140 and/or top vent 147, fluid may flow into the side vent 140 and out of the top vent 147, into the top vent 147 and out of the side vent 140, or into and out of both vents 140, 147. In this way, the design is versatile to be adapted to the needs of particular applications and orientations. As illustrated in the difference between FIGS. 13A and 13B, the fluid chamber 127 in its expanded position (13B) is not much larger than the fluid chamber 127 in its collapsed position (13A). The volume of the fluid chamber 127 is a result of the diameter of the air pump and the distance of vertical movement of the voice coil 124.

Because many of the primary applications for this technology relate to very small applications where size is an issue, the use of a very small dimensions is key. In particular embodiments of a fluid pump, the outer diameter of the fluid pump housing may be within 25-80 mm, and the height of the fluid pump housing may be within 6-25 mm. In particular embodiments, the fluid pump housing diameter is 53 mm and its height is 9.6 mm. The specific dimensions required for a particular application may be determined by one of ordinary skill in the art given the particular explanations provided herein. It is contemplated that the types of fluids that embodiments of the fluid pump may be applied to include, without limitation, gases such as air, nitrogen, helium, hydrogen and liquids, such as water, engineered fluid (HFE series), in-vivo blood and medications, such as insulin and other intravenous solutions.

Figure 14:
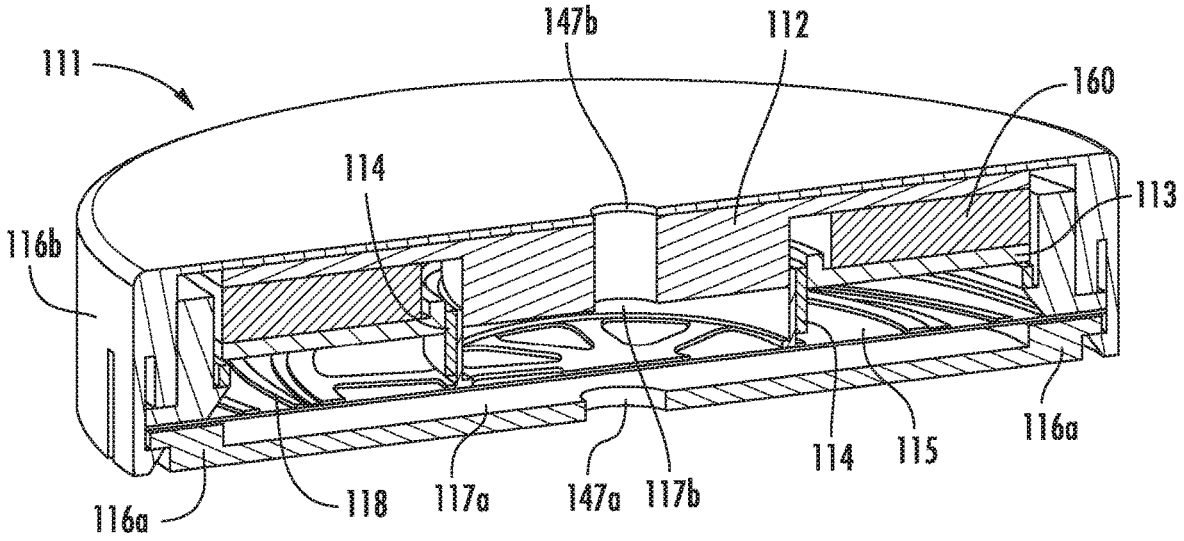
FIG. 14 depicts a cross-sectional perspective view of a fluid pump having the magnet configuration as depicted in FIG. 11.

FIG. 14 illustrates a cross-sectional perspective view of a fluid pump 111 embodiment similar to that of FIG. 11 with the membrane 125 in the relaxed position. The fluid chamber 117 is disposed between the suspension member/membrane portion 118/115 and the top cap of the fluid pump housing 116. In this particular embodiment, top and bottom vents 147 are included to allow fluid to enter and exit the fluid chamber 117 as the voice coil 114 oscillates. In this particular illustration, other fluid pump 111 housing 116 members are shown to assist in positioning the various fluid pump 111 components in appropriate positions relative to each other so that the voice coil 114 may move up and down between the first pole piece 112 and the opposing pole piece 113.

Figure 15:
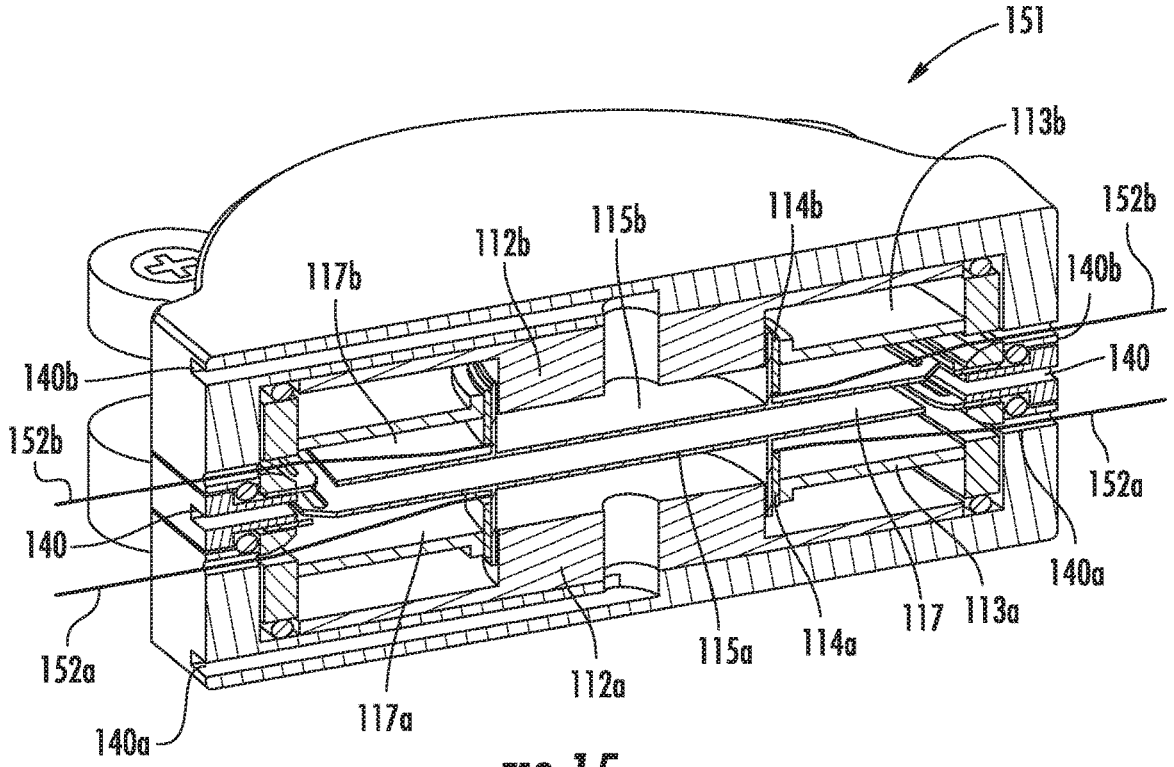

FIG. 15 illustrates a cross-sectional perspective view of a fluid pump 151 illustrating two internal pumping assemblies similar to those illustrated in FIGS. 14 and 11, but integrated into one fluid pump 151 with opposing voice coils 114*a*, 114*b*, first pole pieces 112*a*, 112*b*, opposing pole pieces 113*a*, 113*b* and membranes 115*a*, 115*b*. The supporting magnet is removed in this illustration for ease of viewing the rest of the design components. Vents 140, 140*a*, 140*b* are shown at various locations for allowing fluid to flow into and out of the respective side fluid chambers 117*a*, 117*b* and center fluid chamber 117. In operation, the two opposing assemblies may be run in phase or out of phase. In phase, the respective voice coils 114*a*, 114*b* move outward to their relaxed positions and inward to their extended positions simultaneously. Out of phase, the respective coils 114*a*, 114*b* move outward to their relaxed positions and inward to their extended positions at different times. Although movement in phase is most likely to achieve optimal fluid pumping capacity, strength and efficiency, there may be some applications where optimal operating conditions are not preferred. Electrical wires 152*a*, 152*b* are coupled to each of the respective voice coils 114*a*, 114*b* so that the electrical currents flowing through the respective voice coils 114*a*, 114*b* may be controlled to change the polarity of the current flowing through the wires forming the voice coils 114*a*, 114*b*. As explained earlier, changing the polarity of the current flowing through the voice coils 114*a*, 114*b* causes the voice coils to move up or down in relation to the first pole pieces 112*a*, 112*b* and respective opposing pole pieces 113*a*, 113*b*.

As can be seen in various embodiments throughout this disclosure, flow vents 140, 145, 147 (both inlets and outlets) can be placed for vertical flow (top or bottom of the fluid pump), or orizontal flow (on a side of the fluid pump), or both. Flow vents 140, 145, 147, may be placed above or below the membrane and vents for particular flow paths may be aligned for particular flow directions, or rotated with respect to each other so that they do not align. Venting assemblies can be stacked or separated depending upon the particular embodiment and fluid flow needs of a particular application of the technology.

Figure 16A:
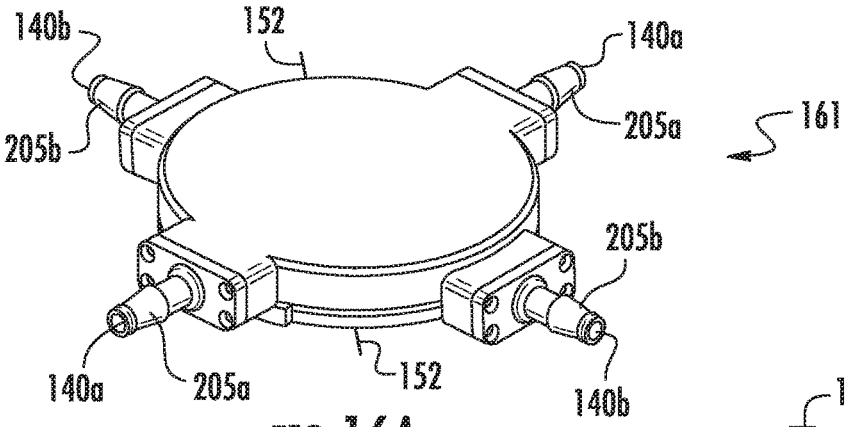
FIGS. 16A and 16B depict, respectively, perspective and plan views of a two-way fluid pump with two separate flow paths.
Figure 16B:
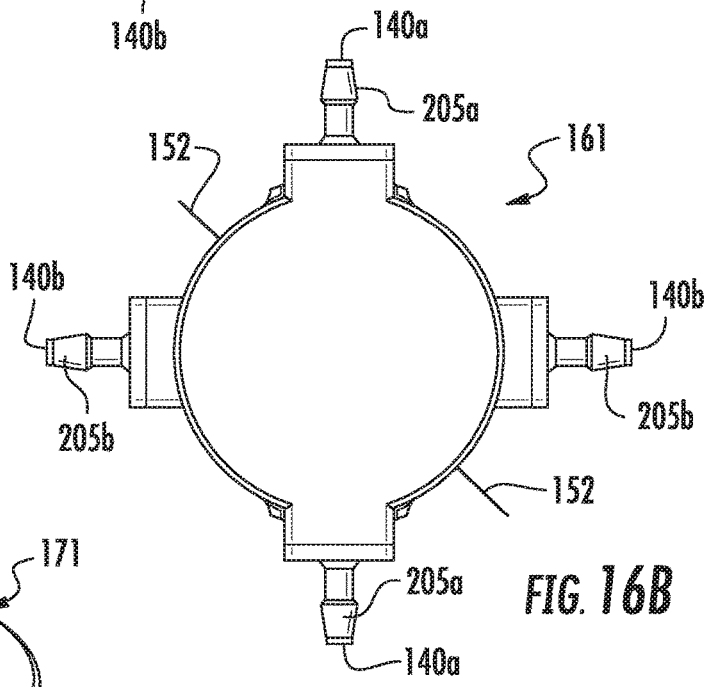
Figure 17A:
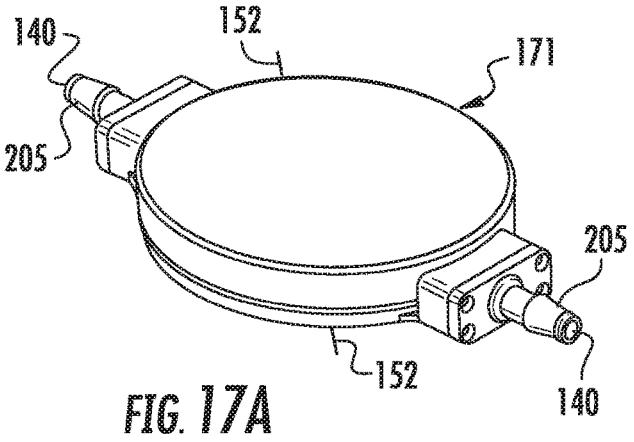
FIGS. 17A and 17B depict, respectively, perspective and plan views of a one-way fluid pump.
Figure 17B:
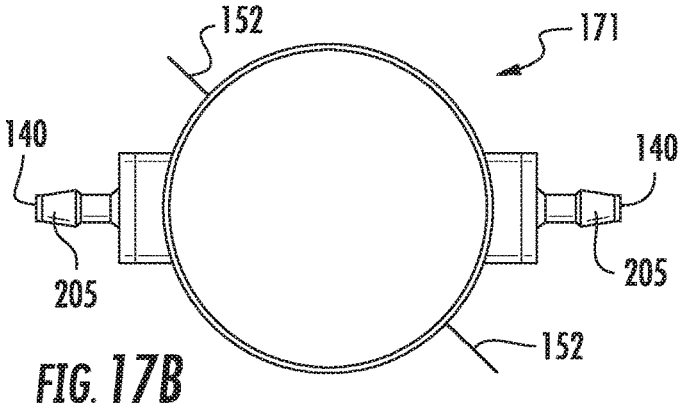

FIGS. 16A and 16B illustrate, respectively, a perspective view and a plan view of a two-way fluid pump 161 with two separate flow paths. Similar to the embodiment illustrated in FIG. 15, the embodiment illustrated in FIGS. 16A and 16B include dual pump assemblies and separate fluid flow paths. Rather than the vents entering the pump housing adjacent to each other and exiting adjacent to each other as shown in FIG. 15, the vents 140*a*, 140*b* are shown to enter and exit on different sides of the pump housing. Fluid vents 140*a* are associated with a first pump assembly, and fluid vents 140*b* are associated with a second pump assembly within the fluid pump housing. Check valves 205*a* and 205*b* are used to regulate direction of flow through the fluid pump. Electrical contact wires 152 are electrically coupled to the voice coils (not shown) to power their movement. The power source and/or controller for this and other embodiments is an oscillating electrical current. Particular embodiments use either a sine-wave or square wave signal. A sine-wave signal produces less mechanical force but is quieter. Those of ordinary skill in the art know how to generate a sine or square wave using a function generator and amplifier, a DC to AC converter, an AC to AC inverter, or other methods known in the art. FIGS. 17A and 17B illustrate, respectively, a perspective view and a plan view of a one-way fluid pump 171 similar to the configuration of FIGS. 16A and 16B, but with only two vents 140 and two check valves 205.

Figure 18A:
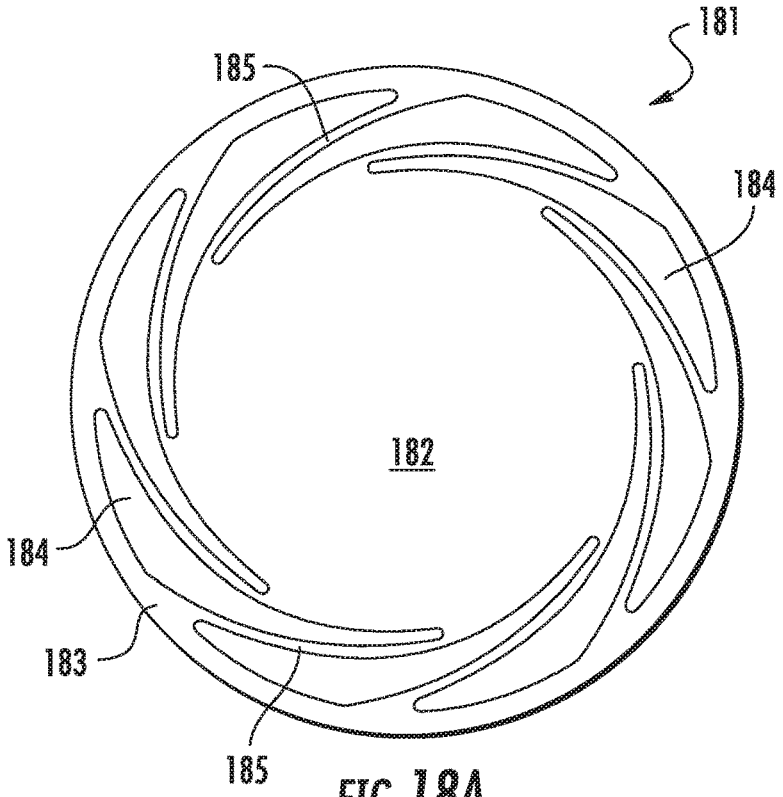
FIG. 18A depicts a first embodiment of a one-piece membrane/suspension design.
Figure 18B:
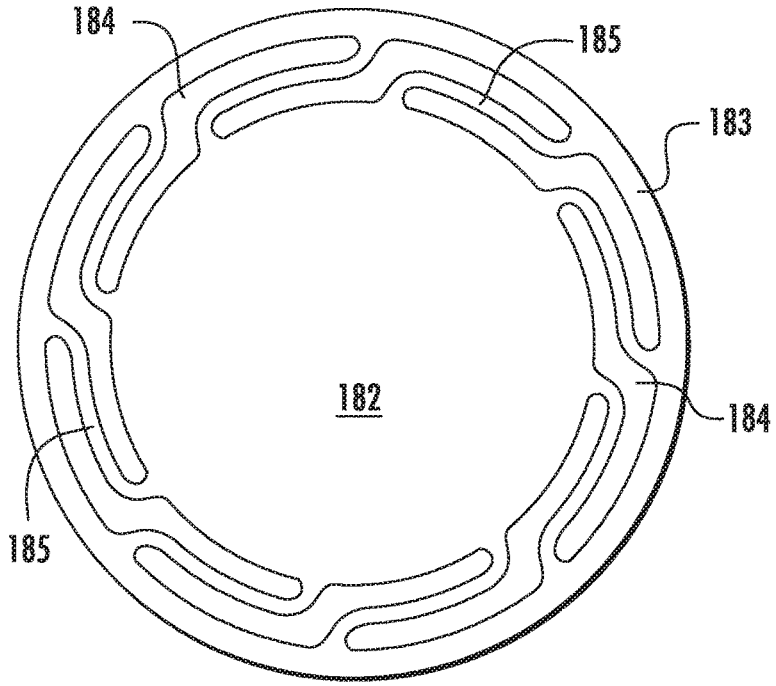
FIG. 18B depicts a second embodiment of a one-piece membrane/suspension design.

FIGS. 18A and 18B depict a membrane 181 in, respectively, extended (18A) and relaxed (18B) positions. The membrane 181 comprises a center membrane 182, an outer border 183, and a suspension section 185 extending between the center membrane 182 and outer border 183. In the particular embodiments of FIGS. 18A and 18B, the suspension section 185 is formed of spokes 185. A polymeric seal 184 extends between the suspension spokes 185 for fluid containment. Although the particular embodiments use a plurality of individual spokes 185, the suspension section 185 may be accomplished by a material change from the center membrane 182. For example, an elastomeric silicone film or other reflexive may be formed around the center membrane as the suspension section 185. Whether formed The polymeric seal 184 may be glued to the center membrane 182 and optionally to the outer border 183, but not to the suspension section 185 itself so that the movement of the suspension section 185 is not restricted and the suspension section 185, and its spokes if they are used, is allowed to expand and contract as the voice coil moves. In particular specific embodiments, the polymeric seal is a 0.25 mm Silicon film with a durometer rating of 10. The outer border 183 may be attached to a the fluid pump housing or other structure within the fluid pump housing and the center membrane 182 is coupled to the voice coil so that it moves with the voice coil. As the current running through the voice coil wires establishes an electro-magnetic field around the wires and causes the voice coil to move to its extended position, the voice coil moves the center membrane 182 with it, stretching out the suspension section 185. When the current running through the voice coil stops or changes polarity so that the voice coil moves back to its relaxed position and the suspension section 185 relaxes as well.

As can be seen from the illustrations provided in the two embodiments of FIGS. 18A and 18B, the membrane 181 may be integrally formed of a single material by injection molding, stamping, heat forming or other process known in the art of forming small thin planar shapes from metal or plastic. In particular embodiments, the polymeric seal 184 and the suspension section 185 may be different only in the thickness of the material forming the respective structures (thicker material for the spokes, for example). In other embodiments, they may be the same material and thickness. In particular embodiments, the polymeric seal may be added as a second layer over the entire membrane 181 surface or only over the suspension section 185, including the spokes 185 if used, to create the polymeric seal. The embodiment of FIG. 18A shows a first spoke configuration and the embodiment of FIG. 18B shows a second spoke configuration.

The membrane may be formed of a metal or polymer material that has some elasticity and is biased to a relaxed position, such as aluminum, rubber or other polymer, or some flexibility that allows it to be moved between a relaxed and an extended position, such as a polymer, Kevlar, fiberglass, carbon fiber or stiff, light metal such as aluminum. It is generally desirable to make the membrane, including the membrane spokes, as light as possible so that the moving mass is light. The lighter the moving mass, the higher the resonant frequency of the moving system and, thus, the higher the air flow from the pump. The amount of flexibility or elasticity required depends upon the particular application, but should allow the center membrane 182 to move to a different plane from the outer border 183 by several (at least two) millimeters difference so that the voice coil can move to generate a pumping action within the fluid pump. The membrane, excluding the spokes, should be sufficiently thick and/or stiff to not warp during movement. The spokes also should be stiff for a higher resonant frequency, but not so stiff that it takes excessive electrical power to move sufficient distance at resonant frequency. Typically, spoke stiffness may be optimized experimentally through stiffness and geometry. In particular embodiments, just the membrane spokes portions of the membranes is thinned and the spoke shape is curved to increase the length to become effectively more compliant without changing the materials used. In these or other particular embodiments, the center membrane 182 area may be removed or left open, leaving only a ring around an opening onto which a separate circular membrane of a different material may be attached. This would allow an independent tuning of the spoke stiffness and the membrane properties for a particular implementation.

Figure 19A:
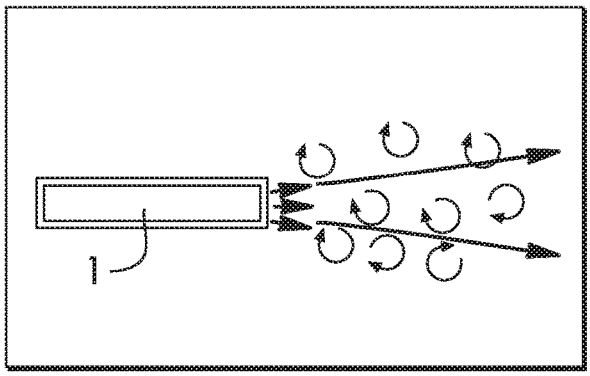
FIG. 19A depicts a side view schematic of an embodiment of a fluid pump in use promoting fluid mixing, with forced flow in one direction.
Figure 19B:
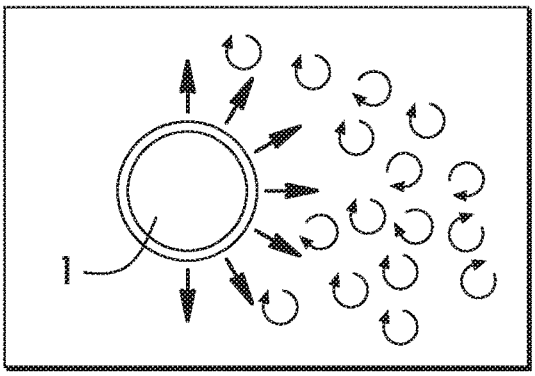
FIG. 19B depicts a top plan view schematic of an embodiment of a fluid pump in use promoting fluid mixing, with forced flow through multiple openings.

FIGS. 19A and 19B provide two illustrations of a fluid pump 1, according to any embodiment of a fluid pump shown or described in this disclosure, in which the fluid pump 1 is used to promote fluid mixing. FIG. 19A depicts a side view of a fluid pump 1, wherein the fluid pump 1 is generating forced convective flow in one direction. FIG. 19B depicts a top plan view of a fluid pump 1 having multiple openings and generating flow in multiple directions. Fluid pump 1 may also be located at certain locations in a system or device in which the fluid pump 1 is incorporated to provide the direct convective flow where ambient flow is difficult to reach.

Figure 20:
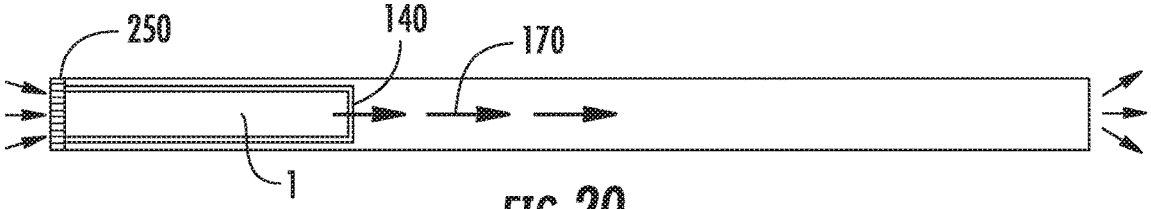
FIG. 20 depicts a cross-sectional side view schematic of an embodiment of a fluid pump applied to generate bulk fluid flow through flow passages.

A fluid pump 1 may also be used in a variety of systems and devices and in a wide range of applications such as, without limitation, notebook PC's, smart phones, tablets, laptops and other personal and business computing devices, solar device cooling, medical, industrial, aerospace and defense uses, pace makers, insulin injection, IV injections, other wearables, such as fluid circulation in clothing, solar powered products, and other devices and systems. FIGS. 20, 21, 22, 23A, 24A and 24B each depict examples of embodiments of fluid pumps 1 incorporated into various systems and configurations. FIG. 20 depicts a fluid pump 1 placed in a flow passage to generate bulk fluid flow for heating or cooling. In this embodiment, vent 250 permits air to enter fluid pump 1. Air flow is then generated by fluid pump 1 and forcibly directed through nozzle opening 140 toward the system requiring bulk fluid flow 170. This configuration, as well as the configurations depicted in the illustrations which follow, will vary depending upon design and performance requirements as well as the type of system in which the fluid pump 1 is incorporated.

Figure 21:
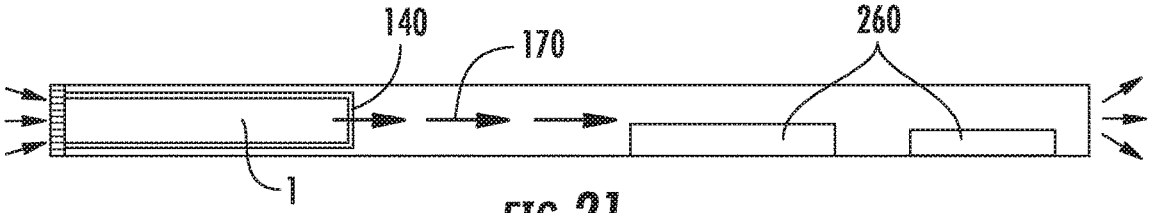
FIG. 21 depicts a cross-sectional side view schematic of an embodiment of a fluid pump applied to an electronic system or device cooling in low z-profile.

FIG. 21 depicts a fluid pump 1 utilized in applications wherein systems or devices are cooled. Ambient or cooling air is drawn in through vent 250 and passed through fluid pump 1. Air flow generated by the fluid pump 1 is forced through nozzle opening 140 and over heated components 260 to provide convective cooling. Thus, components 260 are cooled via the forced convection generated by the air flow from the fluid pump 1.

Figure 22:
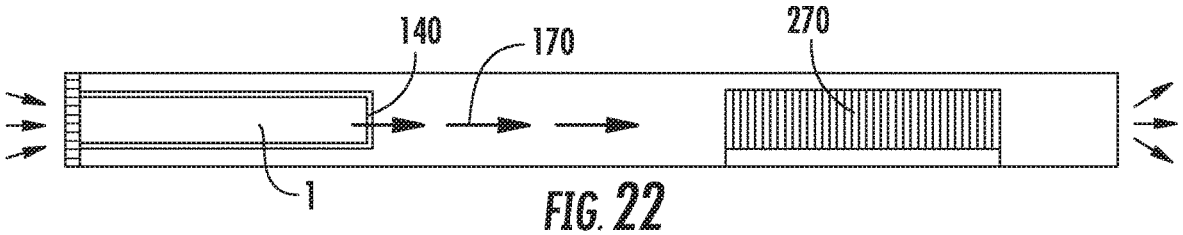
FIG. 22 depicts a cross-sectional side view schematic of an embodiment of a fluid pump applied to microprocessor cooling.

FIG. 22 depicts a fluid pump 1 in an application for cooling a microprocessor. As in the illustration depicted in FIG. 21, ambient or cooling air is drawn in through vent 250 and passed through the fluid pump 1. The forced air flow generated by the fluid pump 1 is forced through nozzle opening 140 and over heat sink 270 to provide convective cooling. In certain embodiments, the fluid pump 1 depicted in FIG. 22 may be either directly mounted on a microprocessor, or on the heat pipe bridging a bare-die silicon CPU.

Figure 23A:
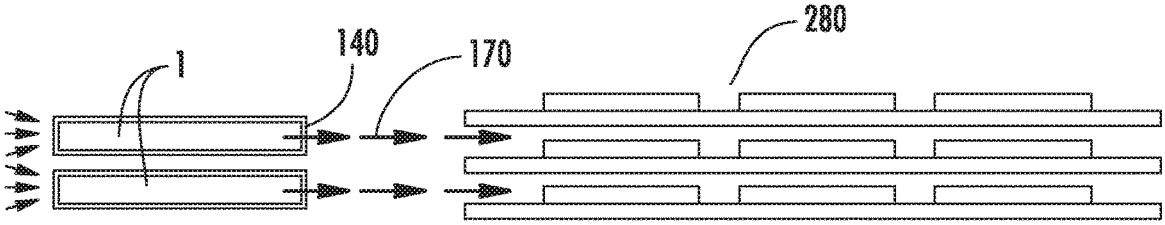
FIG. 23A depicts a cross-sectional side view schematic of an embodiment of a fluid pump applied to cooling memory modules or server blades.
Figure 23B:
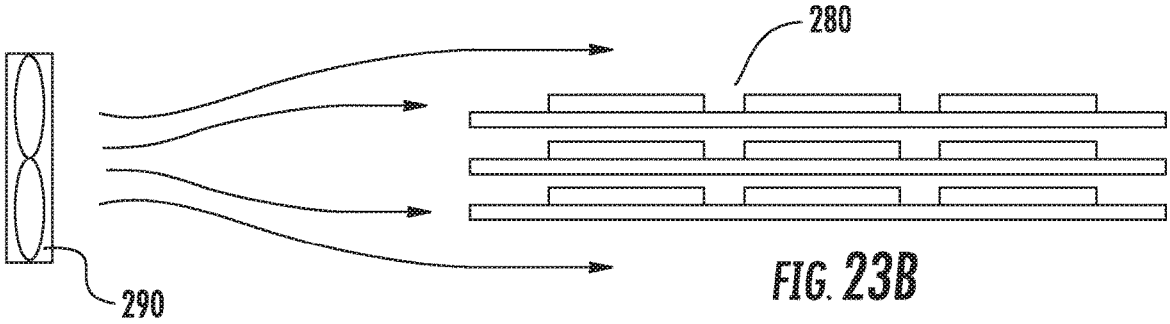
FIG. 23B (PRIOR ART)
FIG. 23B depicts a cross-sectional side view schematic of the difficulties encountered in the prior art in cooling the memory modules or server blades depicted in FIG. 15A.

FIGS. 23A and 23B illustrate the advantages of the present invention over conventional cooling solutions. FIG. 23A illustrates a particular application of a fluid pump 1, where multiple fluid pump units are positioned to cool stacked server blades, systems or memory modules 280. The cooling air forced from nozzle opening 140 of the fluid pump 1 and provides strong and direct air flow through small gaps between blades or modules 280 to increase cooling performance. Generally, an array of fluid pumps 1 can form a modular device.

In contrast to the illustration of FIG. 23A, FIG. 23B depicts a conventional cooling configuration that includes a traditional cooling fan 290 which attempts to force air through the gaps in the server blades or memory modules 280. However, as depicted in FIG. 23B, this configuration does not permit the ambient bulk air flow to reach far into the system because the main stream of the ambient air flow bypasses the memory or server modules altogether. By controlling placement of the air pumps and locating the smaller possible sizes of the air pumps closer to the devices to be cooled, the air flow coming from the nozzles of the fluid pumps can be better controlled and directed to the devices to be cooled.

Figure 24A:
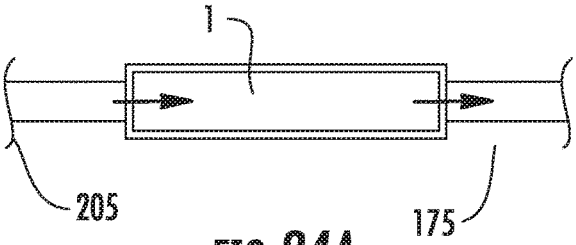
FIG. 24A depicts a cross-sectional side view schematic of an embodiment of a fluid pump comprising check valves, arranged in an end-to-end configuration.
Figure 24B:
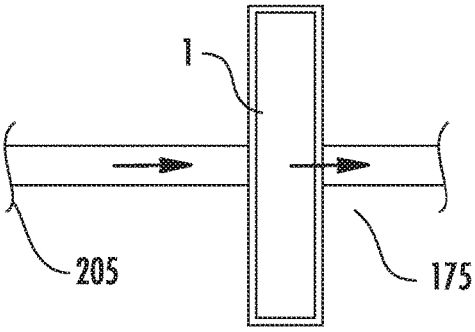
FIG. 24B depicts a cross-sectional side view schematic of an embodiment of a fluid pump comprising check valves, arranged in a side-to-side configuration.

FIGS. 24A and 24B illustrate the use of fluid pumps 1 as a microfluidic pump. In this illustration, each fluid pump comprises check valves 205 which provide a unidirectional flow of liquid or gas 175 through the system. Liquid or gas 175 may travel through the fluid pumps 1 lengthwise, as shown in FIG. 24A. Alternatively, liquid or gas 175 may travel through the fluid pumps 1 crosswise, as shown in FIG. 24B.

While this disclosure includes a number of embodiments in different forms, there is presented in the drawings and written descriptions in the following pages detail of particular embodiments with the understanding that the present disclosure is to be considered as an exemplification of the principles of the disclosed methods and systems, and is not intended to limit the broad aspect of the disclosed concepts to the embodiments illustrated. Additionally, it should be understood by those of ordinary skill in the art that other structures, manufacturing devices, and examples could be intermixed or substituted with those provided. In places where the description above refers to particular embodiments, it should be readily apparent that a number of modifications may be made without departing from the spirit thereof and that these embodiments and implementations may be applied to other technologies as well. Accordingly, the disclosed subject matter is intended to embrace all such alterations, modifications and variations that fall within the spirit and scope of the disclosure and the knowledge of one of ordinary skill in the art. As such, it will be evident that various modifications and changes may be made thereto without departing from the broader spirit and scope of the inventions as set forth in the appended claims. The specification and drawings are, accordingly, to be regarded in an illustrative sense rather than a restrictive sense.

What is claimed is:

1. A fluid pump comprising: a fluid pump housing comprising a housing base and a top cap, the housing base formed by a magnetically conductive first pole piece; a center, circular magnet positioned with a first side directly against the housing base and providing the first pole piece with a first polarity, the circular magnet further comprising an opposing side opposite the first side and an annular side extending between the first side and the opposing side, wherein the first pole piece extending across the first side and radially outward beyond the annular side of the circular magnet and turning toward the opposing side to form an annular housing wall that surrounds the annular side of the circular magnet; an opposing pole piece having a second polarity different from the first polarity, the second polarity provided by the circular magnet, the opposing pole piece positioned within the fluid pump housing directly against the opposing side of the circular magnet and turning near an edge of the opposing side of the circular magnet to extend toward the first side as an annular side wall, the opposing pole piece having a gap between the opposing pole piece and the annular side of the circular magnet and a space between an annular edge of the opposing pole piece and the first pole piece; a wire coil comprising an electrically conductive wire comprising a first end and a second end, the wire coil movably positioned between the annular housing wall of the first pole piece and the annular side wall of the opposing pole piece, and surrounding the circular magnet; at least one membrane coupled between the fluid pump housing and the wire coil, a membrane suspension section surrounding the membrane and held about an edge of the membrane suspension section between the housing base and the top cap, the membrane configured to move responsive to movement of the wire coil by elongating the membrane suspension section; and at least two vents extending through at least one wall of the fluid pump housing to a fluid chamber positioned immediately adjacent to the at least one membrane between the at least one membrane and the fluid pump housing, each of the at least two vents comprising a valve directly coupled to and in fluid communication with one vent of the at least two vents, the valve regulating fluid flowthrough the vent of the at least two vents to which the valve corresponds and configured to establish a direction of fluid flow through the fluid pump; wherein the fluid pump is configured such that application of a current through the coiled wire creates an electro-magnetic field that reacts to a field extending between the first pole piece and the opposing pole piece and causes the wire coil to move in relation to the first pole piece and the opposing pole piece to move the membrane to pump fluid into a first vent of the at least two vents, through the fluid chamber, and out of a second vent of the at least two vents in the direction of fluid flow through the fluid pump.

2. The fluid pump of claim 1, wherein the fluid pump housing comprises an outer diameter between 25 mm to 80 mm and a height of between 6 mm to 25 mm.

3. The fluid pump of claim 1, wherein the membrane is formed of at least one of a metal and a polymer.

4. The fluid pump of claim 1, the membrane suspension section comprising a plurality of spokes extending between the at least one membrane coupled to the wire coil and a membrane outer ring coupled to the fluid pump housing.

5. The fluid pump of claim 4, further comprising an additional polymer seal formed over the plurality of spokes.

6. The fluid pump of claim 1, wherein the at least two vents comprises the at least two vents on opposing surfaces of the fluid pump housing.

7. The fluid pump of claim 6, wherein the opposing surfaces of the fluid pump housing comprise a top surface and a bottom surface of the fluid pump housing or opposing side wall surfaces of the fluid pump housing.

8. The fluid pump of claim 1, wherein the at least two vents comprises the at least two vents on adjacent surfaces of the fluid pump housing.

9. The fluid pump of claim 1, wherein the at least two vents comprises a first vent entering the fluid pump housing through a first side wall of the fluid pump housing and a second vent entering through a second side wall of the fluid pump housing.

10. The fluid pump of claim 1, wherein the wire coil surrounds a portion of the second pole piece and the membrane is positioned adjacent to and movable in relation to the second pole piece.

11. The fluid pump of claim 10, wherein the at least two vents comprises a first vent entering the fluid pump housing through a first side wall of the fluid pump housing and a second vent entering through a top wall of the fluid pump housing.

12. The fluid pump of claim 10, wherein the at least two vents comprises a first vent entering the fluid pump housing through a top wall of the fluid pump housing and a second vent entering the fluid pump housing through a bottom wall of the fluid pump housing.

13. The fluid pump of claim 1, the fluid pump comprising a system of fluid pumps each comprising its own first pole piece, opposing pole piece, wire coil, membrane, at least one vent and fluid chamber as recited in claim 1.

14. The fluid pump of claim 1, wherein the wire coil is a voice coil.

* * * * *